US009783972B2

(12) United States Patent
Davis et al.

(10) Patent No.: US 9,783,972 B2
(45) Date of Patent: Oct. 10, 2017

(54) CISTERN FOR FLUSHING A TOILET WITH POTABLE AND GRAY WATER

(71) Applicants: David Davis, Leeds (GB); Graham Kelly, Leeds (GB)

(72) Inventors: David Davis, Leeds (GB); Graham Kelly, Leeds (GB); Peter Viner, Wetherby (GB)

(73) Assignee: The Green Futures Initiative Limited, Pudsey, Leeds (GB)

( * ) Notice: Subject to any disclaimer, the term of this patent is extended or adjusted under 35 U.S.C. 154(b) by 0 days.

(21) Appl. No.: 14/426,880

(22) PCT Filed: Sep. 6, 2013

(86) PCT No.: PCT/GB2013/052335
§ 371 (c)(1),
(2) Date: Mar. 9, 2015

(87) PCT Pub. No.: WO2014/037734
PCT Pub. Date: Mar. 13, 2014

(65) Prior Publication Data

US 2015/0240467 A1 Aug. 27, 2015

(30) Foreign Application Priority Data

Sep. 7, 2012 (GB) ..... 1215973.7
Jun. 3, 2013 (GB) ..... 1309849.6

(51) Int. Cl.
*E03D 5/00* (2006.01)
*E03D 1/33* (2006.01)
*E03D 1/35* (2006.01)

(52) U.S. Cl.
CPC ..... *E03D 5/006* (2013.01); *E03D 1/33* (2013.01); *E03D 1/35* (2013.01)

(58) Field of Classification Search
CPC ..... E03D 5/006; E03D 5/003
(Continued)

(56) References Cited

U.S. PATENT DOCUMENTS 985,782 A * 3/1911 Cook ..... E03D 1/34 138/26
3,995,327 A 12/1976 Hendrick
(Continued)

FOREIGN PATENT DOCUMENTS

CN 201762767 U 3/2011
DE 4037389 A1 5/1992
(Continued)

OTHER PUBLICATIONS

Machine Translation for DE 10057592 A1.*
(Continued)

*Primary Examiner* — Erin Deery
(74) *Attorney, Agent, or Firm* — Gesmer Updegrove LLP

(57) ABSTRACT

A cistern comprises an upper water tank as a first chamber, and a lower water tank as a second chamber connected by an opening. At the top of the upper tank a mains water inlet allows mains water into the tank through an inlet valve, which is under the control of an upper float. An auxiliary water inlet allows water from an auxiliary supply, such as condensate from an air-conditioning unit, into the tank. At the bottom of lower tank is an water outlet, which allows flushing water from the lower tank 104 to flush an appliance (not shown) under the control of an outlet valve. The outlet valve is under the control of an actuator, which is configured to move up and down, and is also under the control of a lower float.

12 Claims, 5 Drawing Sheets

(58) Field of Classification Search
USPC ..... 4/665, 364, 363, 394
See application file for complete search history.

(56) References Cited

U.S. PATENT DOCUMENTS

| | | | | |
|---|---|---|---|---|
| 4,371,992 | A * | 2/1983 | Rivera | E03D 5/006 4/353 |
| 5,341,529 | A * | 8/1994 | Serrano | E03D 5/006 4/665 |
| 5,557,812 | A * | 9/1996 | Sayant | E03B 1/04 4/665 |
| 5,813,047 | A | 9/1998 | Teichroeb | |
| 6,550,264 | B1 * | 4/2003 | Cantolino | C02F 1/688 210/199 |
| 9,074,356 | B2 * | 7/2015 | Tarantino | E03B 1/042 |
| 2002/0095719 | A1 | 7/2002 | Hand | |

FOREIGN PATENT DOCUMENTS

| | | | |
|---|---|---|---|
| DE | 19844466 | A1 | 3/2000 |
| DE | 19916001 | A1 | 10/2000 |
| DE | 20106678 | U1 | 7/2001 |
| DE | 10057592 | A1 | 6/2002 |
| GB | 2287485 | A | 9/1995 |
| GB | 2505744 | A | 3/2014 |

OTHER PUBLICATIONS

Search Report issued by British Intellectual Property Office in related Patent Application No. GB1309849.6 dated Oct. 23, 2013 (5 pages).

Search Report issued by British Intellectual Property Office in related Patent Application No. GB1215973.7 dated Oct. 12, 2012 (4 pages).

Search Report issued by International Search Authority in related International Patent Application PCT/GB2013/052335 dated Jan. 27, 2014 (3 pages).

* cited by examiner

CISTERN FOR FLUSHING A TOILET WITH POTABLE AND GRAY WATER

PRIORITY INFORMATION

The present invention is a continuation of PCT Application No. PCT/GB2013/052335 filed Sep. 6, 2013, that claims priority to GB Application No. 1215973.7, filed on Sep. 7, 2012 and GB Application No. 1309849.6, filed on Jun. 3, 2013, all of which are incorporated herein by reference in their entireties.

The present invention relates to an apparatus and a method for capturing condensate, and is concerned particularly with capturing condensate for use in a flushing apparatus, such as a flushing water closet.

Air conditioning systems are widely used in both workplaces and living accommodation to provide an atmosphere that is comfortably cool. This is especially true in locations where the ambient temperature would otherwise be too high for comfortable occupation.

When air is cooled by an air conditioning system, moisture in the air condenses and the liquid water is typically drained away.

Previous attempts have been made to capture the condensate and to put it to useful purpose, such as for flushing water closets. Previous systems have collected condensate from air conditioning units in a building into a common reservoir, from where it is pumped either to a common flushing tank or else to individual header tanks for use in supplying the cisterns of water closets.

Whilst such previously considered systems are appropriate in certain types of installation, they are not without disadvantages. A considerable quantity of pipework is required to move the condensate from its collection point(s) to a storage tank, and pumps and means of controlling the pumps are also needed. This complexity means that they can be expensive to install and maintain. The use of storage tanks also means that the condensate must be treated regularly, for example with a UV light system, in order to prevent stagnation. Furthermore, such centralised systems do not lend themselves easily to retro-fitting of existing buildings.

Accordingly, embodiments of the present invention aim to provide a simple, relatively inexpensive apparatus and method that can be used for collecting condensate from cooling units and using it in flushing appliances.

The present invention is defined in the attached independent claims to which reference should now be made. Further, preferred features may be found in the sub-claims appended thereto.

According to one aspect of the present invention there is provided a cistern for a water-flushable appliance, the cistern comprising a tank for holding a first volume of flushing water, a first water inlet for receiving water from a mains source, the first water inlet being controllable by an inlet valve, and an outlet for discharging flushing water from the tank to a flushable appliance, wherein the cistern has a second water inlet for receiving water from an auxiliary source, and wherein the outlet is controlled by an outlet valve which is operable to discharge a second volume of flushing water from the tank to a flushable appliance, which second volume is less than said first volume.

Preferably, the tank comprises a first chamber and a second chamber, there being fluidic communication between the first chamber and the second chamber through an opening. The fluidic communication may be arranged to be controlled by a communication valve.

Preferably the first water inlet and preferably the second water inlet are arranged in use to introduce water into the first chamber. Preferably the outlet is arranged in use to discharge water from the second chamber.

The communication valve and the outlet valve are preferably under common control, which may be by means of an actuator. Preferably, when the outlet valve is open the communication valve is closed. Preferably, when the outlet valve is closed the communication valve is open.

The volume of water discharged through the outlet valve during a flushing operation is preferably adjustable, and is preferably arranged to be controlled by a float means. The position of the float means with respect to the outlet valve is preferably adjustable to control the volume of water discharged during a flushing operation.

Preferably the inlet valve is a flotation valve. The inlet valve is preferably arranged to allow a maximum quantity of water into the tank, which maximum quantity may be substantially equal to the second volume.

The cistern may be arranged in use to flush an appliance comprising an article of sanitary ware, and more preferably a flushing water closet.

Preferably the second water inlet comprises a filter for filtering water from the auxiliary source.

The cistern may further include an overflow outlet arranged in use to limit the quantity of water in the tank to the first volume. The overflow outlet is preferably arranged in use to discharge overflow water to a flushing appliance.

The tank preferably comprises one or more side walls, a top and a bottom wall. The top may be removable and/or may comprise a removable portion, for inspection or maintenance.

The inlet valve may have an inlet conduit to direct mains water into the tank. The inlet conduit may be positioned adjacent to a side wall of the tank to reduce noise when mains water is being directed into the tank. The inlet conduit may comprise a weir.

In a preferred arrangement the second inlet may be arranged in use to receive water from an auxiliary source comprising a condensate outflow of a cooling unit, such as an air-conditioning unit or refrigeration unit.

The tank may be provided with a hose connecting the first inlet at a wall of the tank with the inlet valve. In a preferred arrangement the cistern comprises two first water inlets arranged on different walls of the tank, which inlets may comprise alternatives.

The cistern may be arranged in use to co-operate with another cistern of a flushing appliance.

In a preferred arrangement the outlet valve is pneumatically operable. Alternatively, or in addition, the outlet valve may be electrically or electronically operable. The outlet valve may be arranged in use to remain open for a predetermined time, once operated, and then to automatically close.

Preferably the volume of water discharged through the outlet valve, when operated, ie the second volume, is adjustable. In a preferred arrangement the amount of water discharged is adjustable by adjustment to the time for which the outlet valve remains open, once operated.

The present invention also includes a water flushable appliance comprising, or arranged to co-operate with, a cistern according to any statement herein.

In another aspect of the present invention there is provided a method of supplying flushing water to a cistern for a flushable appliance, the method comprising directing water from an auxiliary source to a cistern having a tank for holding a first volume of flushing water, a first water inlet for receiving water from a mains source, the first water inlet being controllable by an inlet valve, and an outlet for discharging flushing water from the tank to a flushable appliance, wherein the cistern has a second water inlet for receiving water from the auxiliary source, and wherein the outlet is controlled by an outlet valve which is operable to discharge a second volume of flushing water from the tank to a flushable appliance, which second volume is less than said first volume.

The method may comprise supplying condensate from a cooling unit as the auxiliary source.

The present invention may comprise any combination of the features or limitations referred to herein, except such a combination of features as are mutually exclusive.

Preferred embodiments of the present invention will now be described by way of example only with reference to the accompanying diagrammatic drawings in which.

Figure 1:
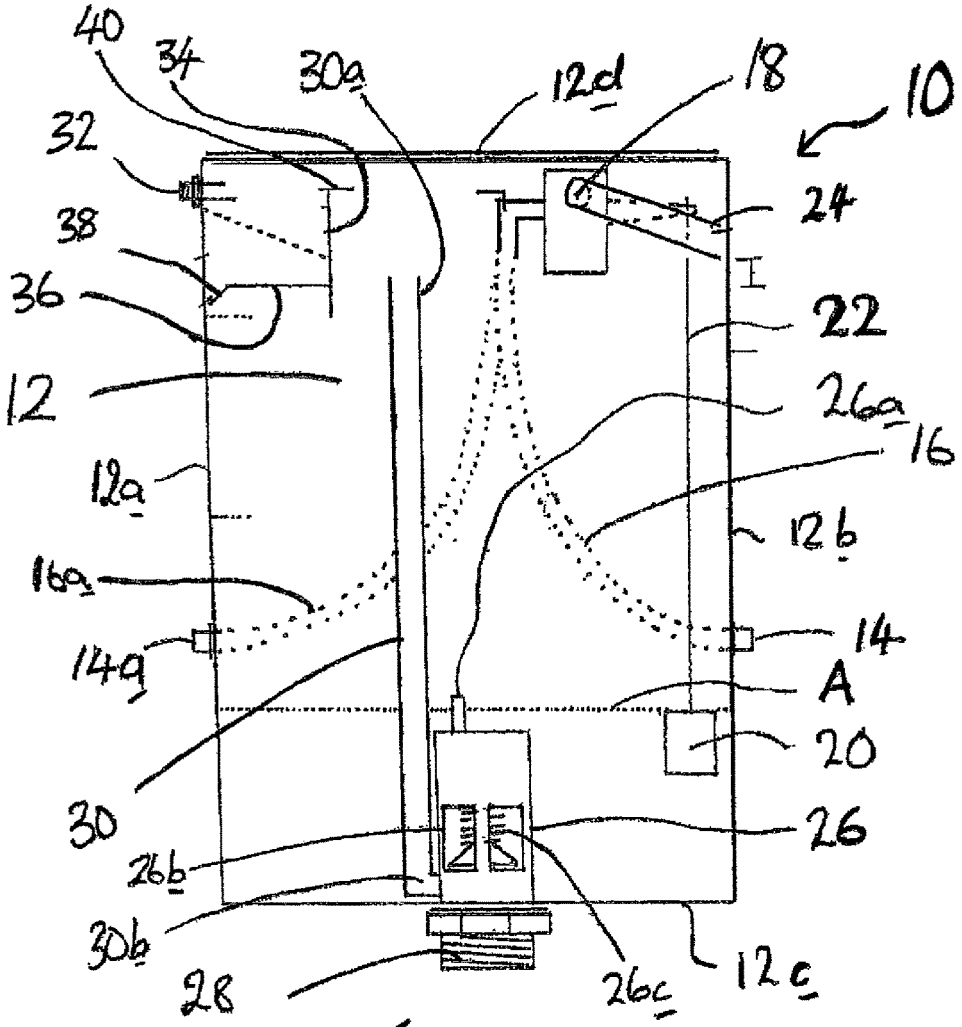
FIG. 1 is a schematic sectional view of a cistern for a flushable appliance, in accordance with an embodiment of the present invention.

FIG. 1 shows generally at 10 a cistern for a flushable appliance, such as a water closet (itself not shown). The cistern 10 comprises a tank 12 having sidewalls 12*a* and 12*b*, a bottom wall 12*c* and a top 12*d*. A mains water inlet 14, which is connected to a mains supply of water (not shown) is connected, via a hose 16, to an inlet valve 18. An alternative mains water inlet 14*a* and hose 16*a* are shown on the opposite side 12*a* of the tank, for use when an alternative installation geometry is required. Inlet 14*a* is closed in this example and the alternative hose 16*a* is shown in broken lines. The inlet valve 18 is a floatation valve and is controlled by a float 20 attached to a rod 22, as are used in previously considered flushing cisterns, where they are variously described as float valves or ballcocks. The inlet valve 18 also has an inlet conduit 24 which is arranged to direct water from the valve 18 onto sidewall 12*b*, in the manner of a weir, so as to minimise the noise generated by incoming water.

An outlet valve 26 communicates with an outlet 28 for discharging flushing water from the tank 12 to a flushable appliance to which the cistern is connected in use. The tank 18 is provided with a main overflow outlet comprising a hollow tube 30 arranged substantially vertically within the tank. The tube is open at an upper end 30*a*, which is located a fixed vertical distance below the bottom of the conduit 24, in order to maintain an air gap between the overflow and the inlet valve, so as to avoid contamination of the mains water supply. The tube 30 communicates directly with the outlet 28 at its lower end 30*b*, to discharge any overflow into the flushing appliance.

The cistern 10 also has a second water inlet 32 which is connectable to an auxiliary water source (not shown). The second water inlet 32 connects to an inlet attenuation box 34 which includes a mesh filter 36, through which water from the second inlet 30 initially passes on entry into the tank, and a weir discharge 38 through which the water leaves the box 34. The box 34 also has an overflow outlet 40 leading into the tank 12.

The top 12*d* of the tank is removable for inspection of the interior of the tank 12 and maintenance of the cistern.

The auxiliary water source to which the second water inlet is connected is a condensation outflow (not shown) from a cooling device such as an air-conditioning condensate outflow.

In this example the tank is arranged to hold a maximum of 18 liters of water. Mains water enters the tank from inlet 14 while valve 18 is open. When the level of water in the tank reaches a level depicted by broken line A the float 20 and rod 22 become raised to the point that the floatation valve 18 closes, preventing further mains water from entering the tank. At this point the tank holds a minimum of approximately 5 liters (the second volume), which is sufficient to flush the flushing appliance.

However water from the auxiliary source may continue to enter the tank via second inlet 32 until a maximum volume of 18 liters is reached (the first volume), whereupon further water passes into the top 30*a* of the overflow tube 30 and out of the tank via outlet 28.

In this example the outlet valve 26 is pneumatically operable via a button 26*a*, connected to the exterior of the tank. The button forces air to the valve via a non-return device (not shown). Once operated the valve 26 remains open for a predetermined amount of time which is arranged to be sufficient to allow a fixed volume of water to be discharged through the outlet 26. The volume discharged upon operation of the valve is typically arranged to be approximately 5 liters (ie the second volume).

The valve itself may be of any suitable design provided that it allows a fixed volume of water to be flushed and does not discharge the entire contents of the tank, as is the case with previously considered cisterns.

In this case the valve 26 comprises an air filled bladder 26*b* which is arranged to raise a seal (not shown) in the valve when button 26*a* is depressed forcing air into the bladder 26*a*, thus opening the valve. The bladder pushes against a spring loaded diaphragm 26*c* which returns the valve to the closed position, simultaneously forcing air from the bladder via a release opening (not shown). The time taken for the valve to close automatically after operation can be adjusted by adjusting the tension of the spring acting against the diaphragm. The spring is located in a watertight compartment to prevent corrosion.

The cistern described above has two sources of flushing water. Condensate, for example from an air-conditioning unit located nearby the cistern, is used to fill the tank up to its maximum first volume of approximately 18 liters. When the flush is operated a maximum second volume of 5 liters is discharged for flushing a WC. In case there is no condensate a mains supply is able to maintain a minimum 5 liters of flushing water. The inlet valve controls the inlet to ensure that only the minimum second volume of water needed for flushing is derived from the mains supply.

Figure 2:
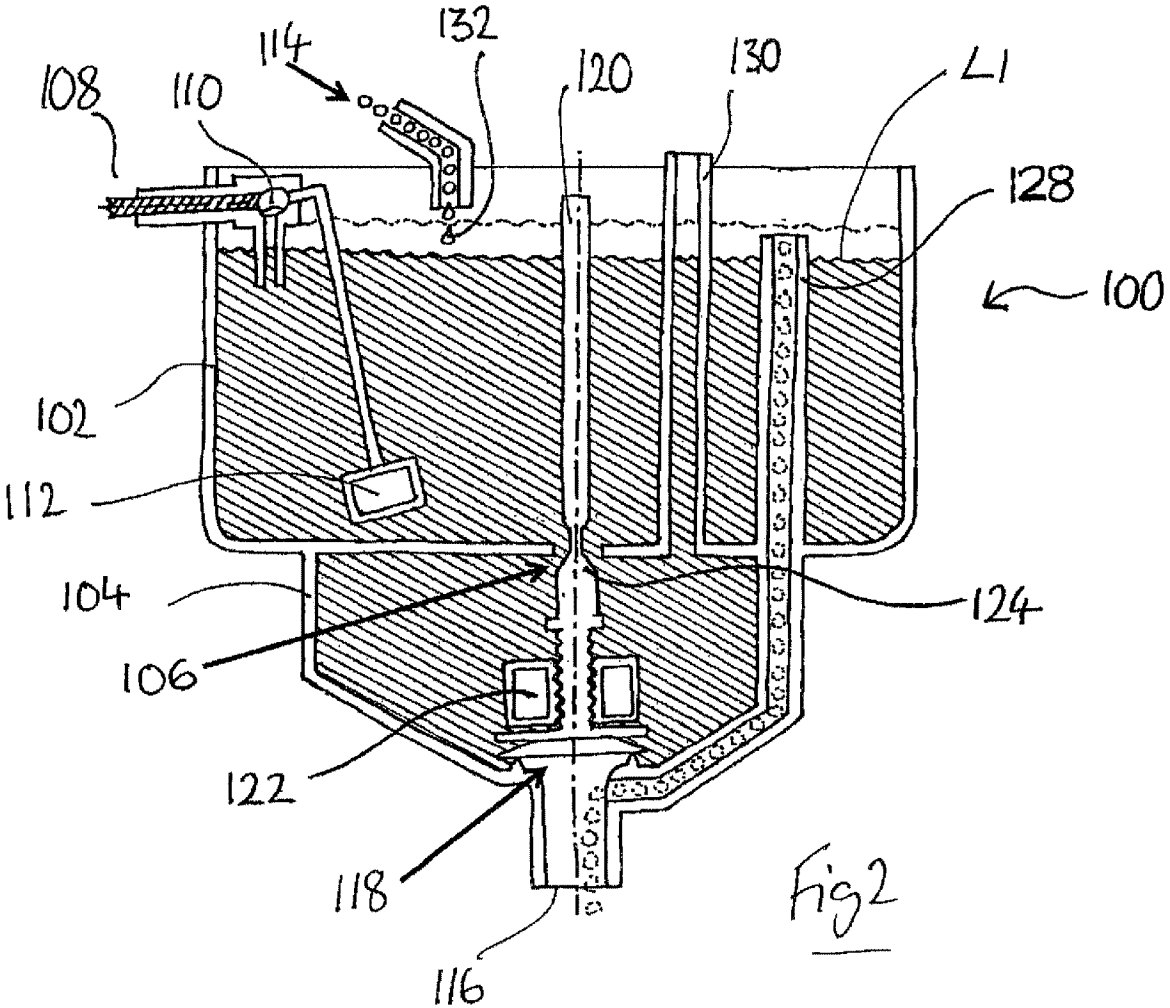
FIG. 2 is a schematic sectional representation of a preferred embodiment of the present invention in a first configuration.

Turning now to FIG. 2, this shows, generally at 100, a preferred embodiment of cistern for using an auxiliary water source, such as condensate from an air-conditioning unit, to flush a flushable appliance (not shown).

Cistern 100 comprises an upper water tank 102 as a first chamber, and a lower water tank 104 as a second chamber connected by an opening 106. At the top of the upper tank 102 a mains water inlet 108 allows mains water into the tank through an inlet valve 110, which is under the control of an upper float 112. An auxiliary water inlet 114 allows water from an auxiliary supply (not shown), such as condensate from an air-conditioning unit, into the tank 102.

At the bottom of lower tank 104 is an water outlet 116, which allows flushing water from the lower tank 104 to flush an appliance (not shown) under the control of an outlet valve 118. The outlet valve 118 is under the control of an actuator 120, which is configured to move up and down, and is also under the control of a lower float 122, as will be described below.

Opening 106 has a communication valve 124, which is also under the control of the actuator 120. Communication valve 124 is moveable between an open configuration, as shown in FIG. 2, in which the upper and lower tanks 102 and 104 are in fluidic communication, and a closed configuration (as will be described below) in which the lower tank 104 is effectively isolated from the upper tank 102.

An overflow conduit 128 conducts any overflow from the upper tank 102 to the outlet 116, and a vent 130 allows air to pass between the upper and lower tanks, as will be described later.

FIG. 2 shows the apparatus in a pre-flush configuration, in which the outlet valve 118 is closed and the communication valve 124 is open. A water level L1 in the upper tank exceeds a level needed to raise the upper float 112 to close mains inlet valve 110. Meanwhile condensate 132 drips into the upper tank, up to a maximum determined by the overflow 128.

Communication valve 124 is open and lower tank 104 is full. A head of water, equating to the height of the water in both the lower tank and the upper tank, exerts a water pressure on the outlet valve 118, ensuring that it remains firmly closed.

Figure 3:
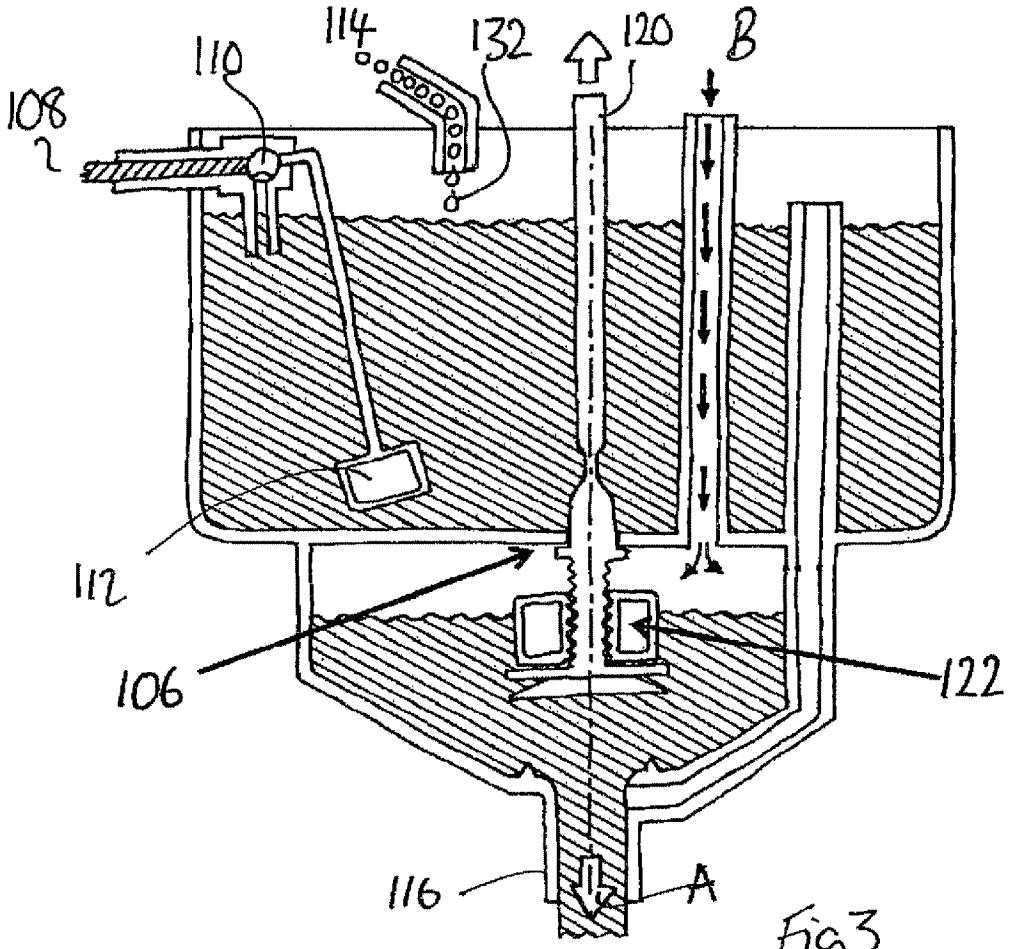
FIG. 3 shows the embodiment of FIG. 2 in a second configuration.

Turning to FIG. 3, this depicts the apparatus immediately after the actuator 120 has been operated to open the outlet valve. The actuator comprises a rod linking the outlet valve and the communication valve. To flush the apparatus the actuator rod is temporarily raised. This could be achieved with pneumatic means, such as a bellows, or could comprise other means, including but not limited to a handle, a pull-knob a button or a chain.

In FIG. 3 it can be seen that the actuator has been raised to open the outlet valve 118, allowing flushing water to exit the lower tank 104 through the outlet 116, as depicted by arrow A. At the same time the actuator 120 has closed the communication valve 124, effectively isolating the lower water tank 104 from the upper water tank 102.

As water drains from the lower tank air is introduced from vent 130, as depicted by arrows B. The lower float 122, buoyed by the water in the lower tank 104, maintains the outlet valve 118 in an open configuration, to allow the flushing to continue.

Figure 4:
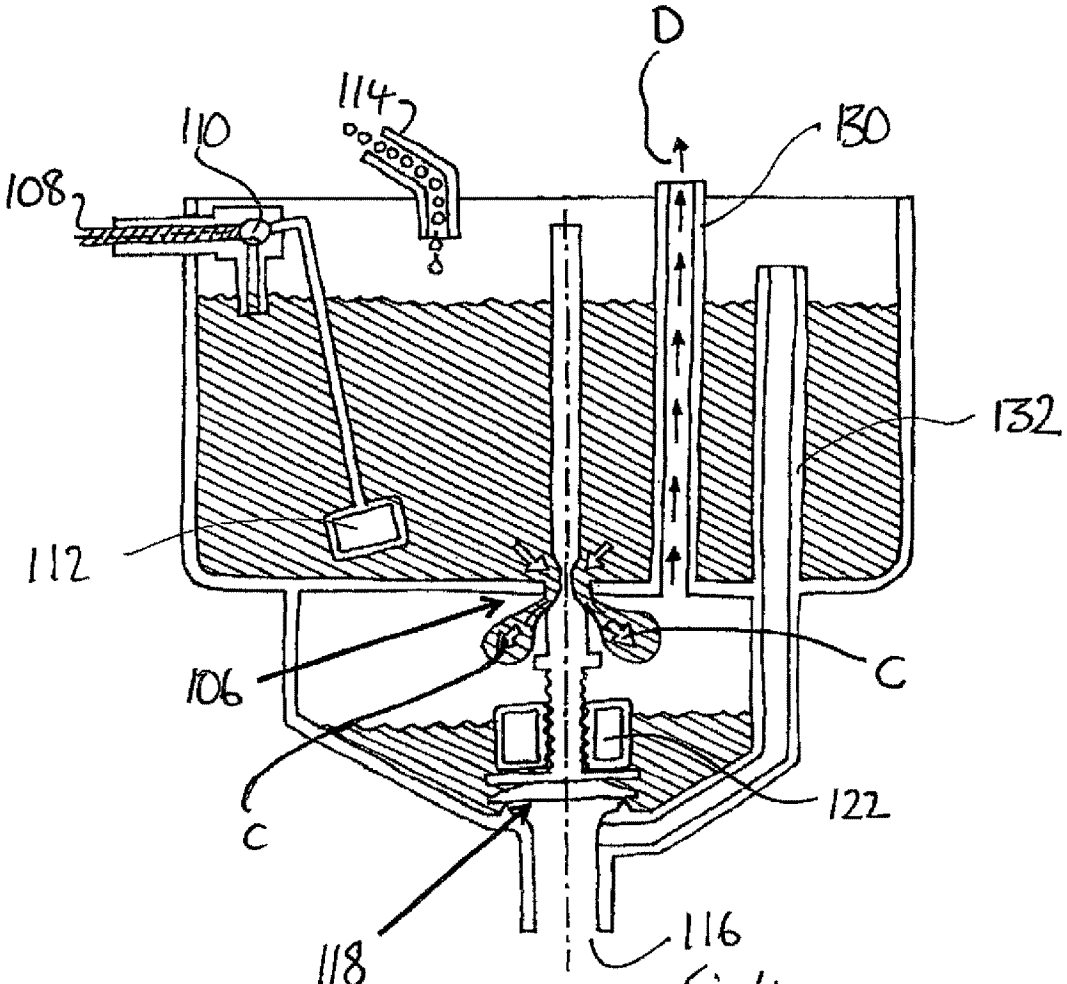
FIG. 4 shows the embodiment of FIGS. 2 and 3 in a third configuration.

FIG. 4 shows the outlet valve 118 once again closed. As the actuator is released the water level in the lower tank 104 reduces and the lower float 122 lowers and eventually closes the valve 118. In practice, as the last water drains away to flush the appliance, a reduced pressure appears below the valve 118 and this produces a syphon effect in the outlet 116 which firmly closes the valve 118. A residual volume of water remains in the lower tank 104 after the valve 118 closes. The residual volume can be adjusted by altering the height at which the lower float mounts on the actuator 120. The closer the position of the float 122 with respect to the outlet valve, the less will be the residual volume of water, as the float will close the valve 118 later. The further the float 122 from the valve 118, the greater will be the residual volume as the float will close the valve 118 sooner.

When the lower float falls, the communication valve reopens and water from the upper tank flows into the lower tank through the opening 106 to replenish the flushing supply, as shown by arrows C. The incoming water forces air up and out through the vent, in the direction of arrows D.

Figure 5:
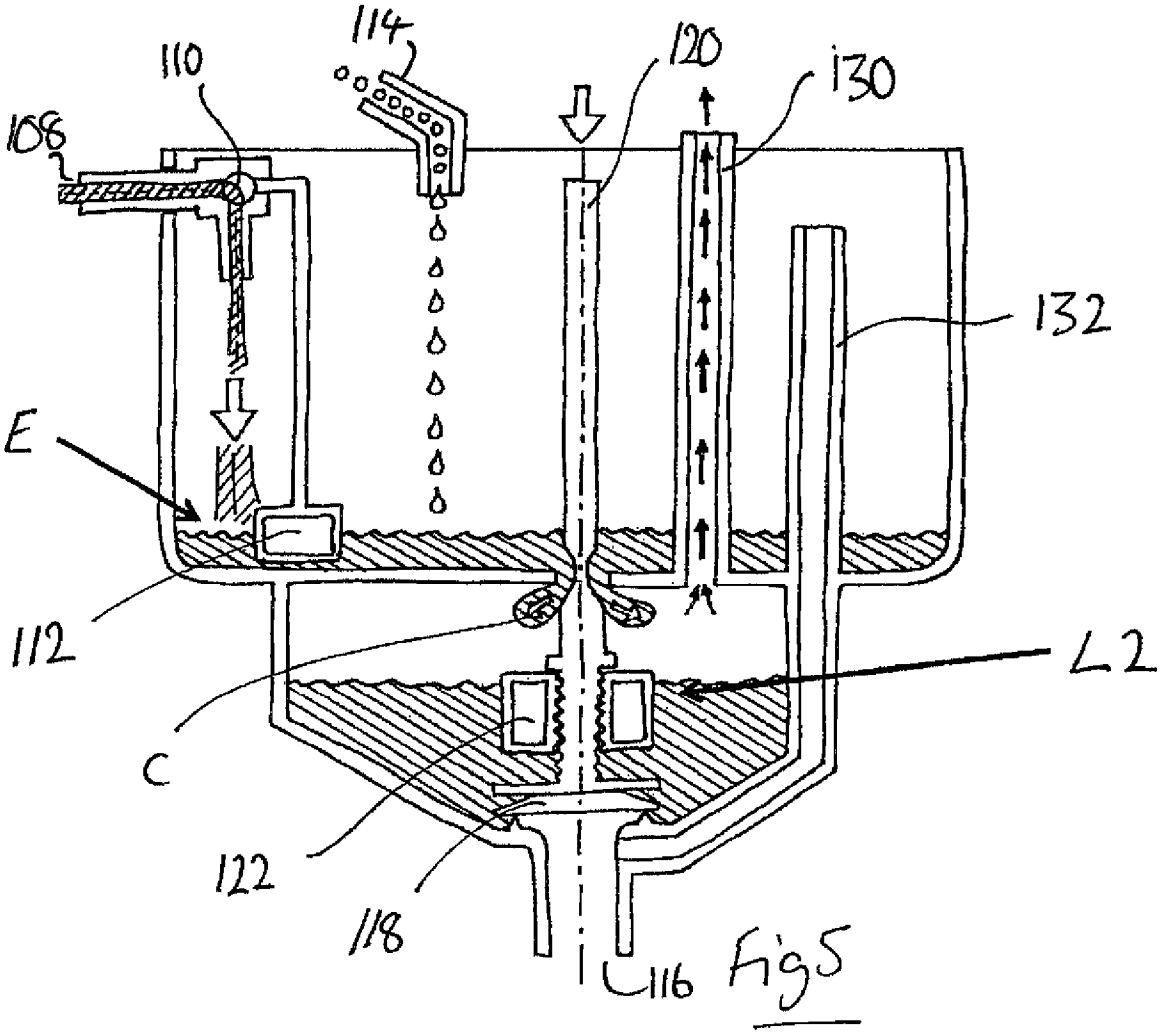
FIG. 5 shows the embodiment of FIGS. 2-4 in a fourth configuration.

FIG. 5 shows the lower tank filling through the opening 106. In this drawing the position of the lower float 122 on the actuator 120 has been adjusted upwards, so that a greater residual volume of water, at level L2, remains in the lower tank 104. Adjustment of the height of the lower float is straightforward as the float is threadedly mounted on the actuator, so that rotation of the float about the rod of the actuator moves it closer to, or further from, the outlet valve 118. It is expected that the height of the lower float would be set at the time of installation.

Water from the upper tank 102 has drained into the lower tank 104, the upper float 112 has fallen and the mains inlet valve 110 has opened accordingly to allow water from the mains into the upper tank, as depicted by arrow E. Only sufficient mains water will be allowed into the apparatus by the inlet valve to permit the lower tank to fill, plus a little extra for quick replenishment of the lower tank after a flush. The rest of the volume of the upper tank will be filled with water from the auxiliary supply 114.

In this example, the upper tank holds a maximum of 12 liters, while the lower tank holds a maximum of 6 liters. The adjustable lower float permits a variable flushing volume of between 2 and 4 liters.

The communication valve 124 and the outlet valve 118 cooperate via the actuator 120 to ensure that the lower tank 104 becomes effectively isolated from the upper tank when flushing is taking place. This ensures that the maximum volume of water that could be discharged from the apparatus in any single flush is 6 liters—which would be released if a user were to hold the actuator open beyond merely operating the flush. Isolating the lower tank also caps the water pressure acting at the outlet. Since the water pressure affects the flow rate, this isolation also allows a greater control of the volume to be discharged during a regular flush.

The cistern described above is able to make use of condensate or other unwanted fluid that would otherwise be discarded. This allows a considerable saving of mains water.

Furthermore, the cistern can be installed either as a new-build or as a retro-fit conversion. It may replace an existing cistern or enhance or extend it by mounting it on top of the existing cistern. If used as an extension to an existing cistern a mounting or coupling member would be needed to increase the capacity of the cistern, perhaps in the form of a flange, as well as an extension or replacement for the existing overflow pipe, to accommodate the greater water level.

As there is no need for extensive pipework or pumps and their control devices, the cost of the cistern, and its installation, can be minimised.

It will readily be understood by the skilled reader that the volumes described above may be different according to requirements of the system.

Whilst endeavouring in the foregoing specification to draw attention to those features of the invention believed to be of particular importance, it should be understood that the applicant claims protection in respect of any patentable feature or combination of features referred to herein, and/or shown in the drawings, whether or not particular emphasis has been placed thereon.

The invention claimed is:

1. A cistern for a water-flushable appliance, the cistern comprising:

a tank for holding a first volume of flushing water;

a first water inlet for receiving water from a mains source, the first water inlet being controllable by an inlet valve;

a second water inlet for receiving water into the tank from an auxiliary source;

and an outlet for discharging flushing water from the tank to said flushable appliance;

the outlet being controlled by an outlet valve which is operable to discharge a second volume of flushing water from the tank to said flushable appliance, wherein said second volume is less than said first volume;

wherein the tank comprises a first chamber and a second chamber, there being fluidic communication between the first chamber and the second chamber through an opening;

the first water inlet and the second water inlet are arranged in use to introduce water into the first chamber, the outlet being arranged in use to discharge water from the second chamber;

wherein the fluidic communication between the first chamber and the second chamber is controllable by a communication valve, the communication valve having a solid outer surface and a section of reduced width that passes within the opening;

wherein the communication valve and the outlet valve are under common control of an actuator; and wherein a float is mounted on the actuator and the second volume of water discharged through the outlet can be adjusted by altering the position of the float on the actuator.

2. The cistern according to claim 1, wherein when the outlet valve is open the communication valve is closed.

3. The cistern according to claim 1, wherein when the outlet valve is closed the communication valve is open.

4. The cistern according to claim 1, wherein the inlet valve comprises a flotation valve.

5. The cistern according to claim 1, wherein the flushable appliance comprises an article of sanitary ware.

6. A cistern according to claim 1, wherein the second water inlet comprises a filter for filtering water from the auxiliary source.

7. The cistern according to claim 1, wherein the cistern further includes an overflow outlet arranged to limit a volume of water of the first chamber.

8. The cistern according to claim 1, wherein the inlet valve has an inlet conduit to direct mains water into the tank, which inlet conduit is positioned adjacent to a side wall of the tank to reduce noise when mains water is being directed into the tank.

9. The cistern according to claim 1, wherein the second inlet is arranged in use to receive water from said auxiliary source that includes a condensate outflow of a cooling unit.

10. A water flushable appliance including the cistern according to claim 1.

11. A method of supplying flushing water to a cistern for a flushable appliance, the method comprising the steps of:

providing a tank for holding a first volume of flushing water, the tank having an outlet controllable by an outlet valve for discharging flushing water from the tank to a flushable appliance;

wherein the tank comprises a first chamber and a second chamber, there being fluidic communication between the first chamber and second chamber through an opening;

wherein the fluidic communication between the first chamber and second chamber is controllable by a communication valve, the communication valve having a solid outer surface and a section of reduced width that passes within the opening;

directing water into the first chamber from a first water inlet and a second water inlet, wherein the first water inlet is controllable by an inlet valve and receives water from a mains source, and wherein the second water inlet receives water from an auxiliary source;

commonly controlling the communication valve and the outlet valve with an actuator; and discharging a second volume of flushing water from the tank to the flushable appliance with the outlet valve that controls the outlet, wherein the second volume is less than the first volume, and wherein the second volume is discharged from the second chamber.

12. The method according to claim 11 wherein the water from the auxiliary source is condensate from a cooling unit.

* * * * *